US006033085A

United States Patent [19]

Bowker

[11] Patent Number: 6,033,085

[45] Date of Patent: Mar. 7, 2000

[54] LIGHTING FIXTURE SUPPORTED ON ELONGATED BASE WITH EASILY REMOVABLE LIGHT TRANSMITTING COVER

[76] Inventor: James W. Bowker, 9085 Mission Blvd., Suite A1, Riverside, Calif. 92509

[21] Appl. No.: 08/939,807

[22] Filed: Sep. 30, 1997

[51] Int. Cl.[7] ..... F21S 3/00

[52] U.S. Cl. ..... 362/223; 362/92; 362/217; 362/225; 362/374; 362/375

[58] Field of Search ..... 362/92, 223, 217, 362/225, 374, 375

[56] References Cited

U.S. PATENT DOCUMENTS 2,913,575 11/1959 Lipscomb ..... 362/223

4,181,928 1/1980 Zelina ..... 362/374

OTHER PUBLICATIONS

Clean Room Series Lighting Fixture Catalog pp. (2).

*Primary Examiner*—Thomas M. Sember
*Assistant Examiner*—Ronald E. Delgizzi
*Attorney, Agent, or Firm*—Sheldon & Mak

[57] ABSTRACT

A lighting fixture has (i) a base, (ii) a support on the base, the support electrically connecting to the fixture, (iii) a light-transmitting cover, removably supported by the base, (iv) end caps covering the open ends of the base, and (v) means for securing the end caps to the base so that the cover can be removed from the base without removing the end caps. This provides easy access to a light for replacement of the light without the need for any tools.

14 Claims, 1 Drawing Sheet

LIGHTING FIXTURE SUPPORTED ON ELONGATED BASE WITH EASILY REMOVABLE LIGHT TRANSMITTING COVER

BACKGROUND

The present invention is directed to lighting fixtures, and in particular, lighting fixtures especially adapted for use in refrigeration units.

Supermarkets and other retail establishments frequently have large refrigeration units for display of goods that require refrigeration or freezing. To enable consumers to easily see the goods stored in the refrigeration unit, internal lighting is typically provided. This lighting can be an elongated, fluorescent light bulb supported on a suitably sized lighting fixture.

These lighting fixtures, which typically incorporate electrical sockets, can have a base and a protective removable cover. The refrigeration unit can have an elongated, light-receiving recess, sized to fit the base so that a significant portion of the base is not easily accessible.

A difficulty with these conventional lighting fixtures is that access to a light that needs replacement, as a result of becoming dim, broken, or burned out, is difficult. In order to remove the cover to have access to the light, it is necessary to extract the base from the light-receiving recess and remove the cover. This can be a time-consuming and expensive operation, with the result that increased operational costs are experienced and lights are not replaced as frequently as they should be.

Another difficulty with these conventional lighting fixtures, and in particular in older installations, either they do not have a protective cover for the lamp, or only have an easily breakable cover. Thus there is a potential hazard from a broken lamp or electrical shock from an exposed socket.

Accordingly, there is a need for a lighting fixture which can be used with existing structures, i.e., the lighting fixture fits into existing lighting recesses, and at the same time provides easy access to a light that needs replacement.

SUMMARY

The present invention satisfies this need. In particular, a lighting fixture according to the present invention is adapted for use with structures requiring lighting, where the fixture can be mounted in a light-receiving recess.

The fixture has an elongated base that is generally U-shaped in cross section, having a bottom wall, opposed side walls, and at least one open end. The base has a support thereon for supporting and electrically connecting a light thereto, and can have a reflector thereon. The fixture includes a light-transmitting cover removably supported by the base. The cover protects the light supported by the base and can be removed from the base without any tools for easy access to the light for replacement of the light.

Typically, the lighting fixture has two open ends and two end caps. Each open end is closed off with one of the end caps. The end caps are secured to the base with securing means so the cover can be removed from the base without removing the end caps. Typically the securing means are fastener receivers extending inwardly from the side walls of the base, and preferably integral with the base, with fasteners securing the end caps to the fastener receivers. In this configuration, the end caps do not overlap the cover, and thus do not interfere with removing the cover.

The cover is preferably elastically flexible, and is retained on the cover by means of a detent that engages an inwardly extending lip on the base. Because the end caps do not retain the cover in place, merely by pressing on the elastically flexible cover to release it from the detent, the cover can be removed from the lighting fixture and a light can be replaced.

Thus, the lighting fixture need not be removed from the light-receiving recess to replace a light, thereby providing easy access for light replacement.

DRAWINGS

These and other features, aspects and advantages of the present invention will become better understood with reference to the following description, appended claims, and accompanied drawings, where:

DESCRIPTION

The present invention provides a lighting fixture that overcomes disadvantages associated with prior art lighting fixtures used in refrigeration and the like.

Figure 1:
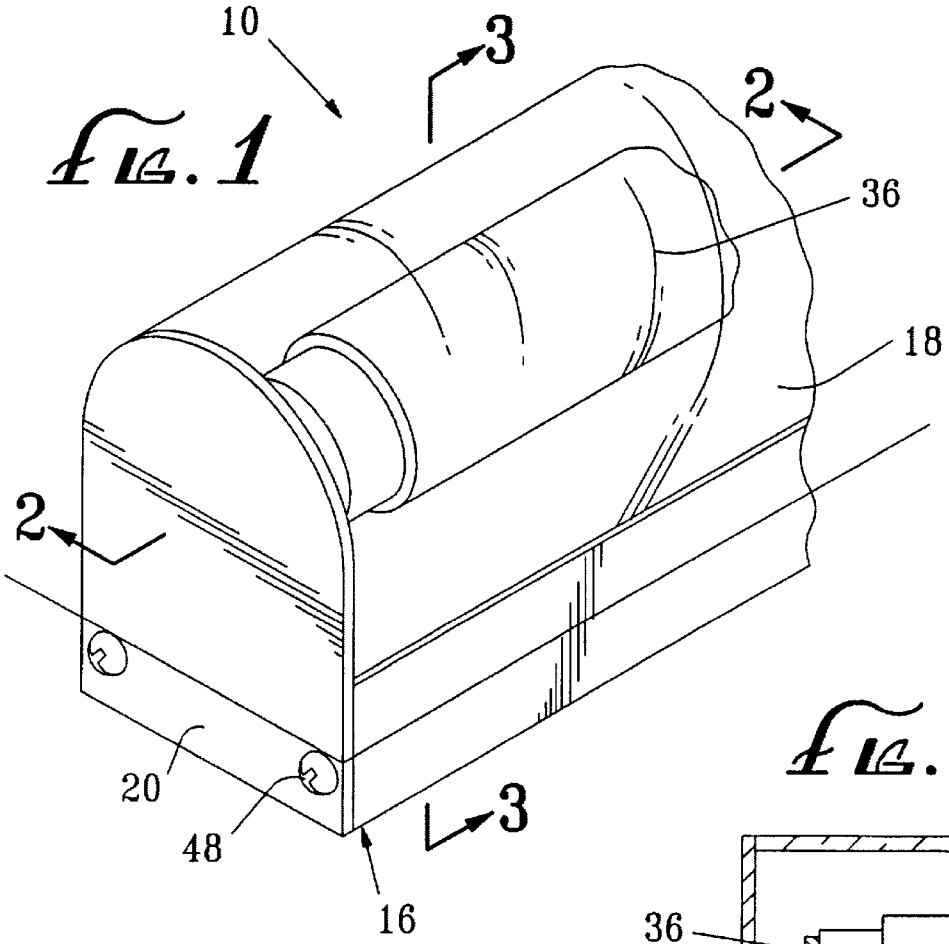
FIG. 1 is a perspective view of an end portion of a lighting fixture according to present invention, mounted in a recess in a structure requiring lighting.

With regard to FIG. 1, a lighting fixture 10 according to the present invention is mounted in a light-receiving recess 12 in a support surface 14. The support surface 14 can be part of a refrigeration unit, a display cabinet, or the like. The lighting fixture comprises a base 16, typically elongated, a cover 18, and a pair of end caps 20, one covering each end of the base 16.

The base 16 comprises a main body portion 22, which is generally U-shaped in cross-section, having a bottom wall 24 and opposed, parallel side walls 26. Each side wall 26 has two inwardly protecting ribs or lips, a bottom lip 28 for supporting a reflective top piece 30 and a top lip 32 for engaging the cover 18, as described below. The top lip 32 is at the uppermost end of the base side walls 26.

Figure 2:
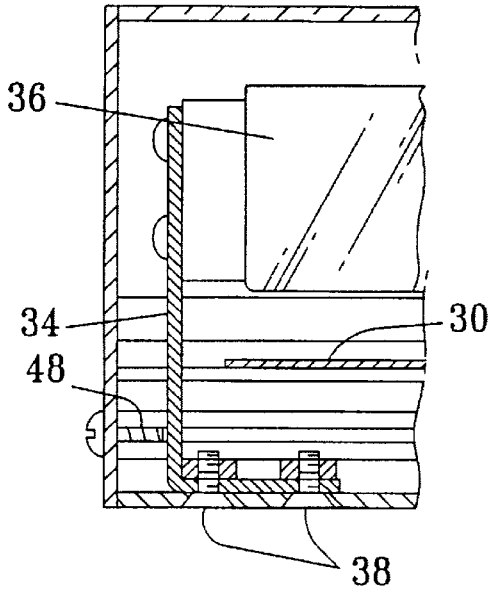
FIG. 2 is a longitudinal sectional view of the lighting fixture FIG. 1, taken on line 2—2 in FIG. 1.
Figure 3:
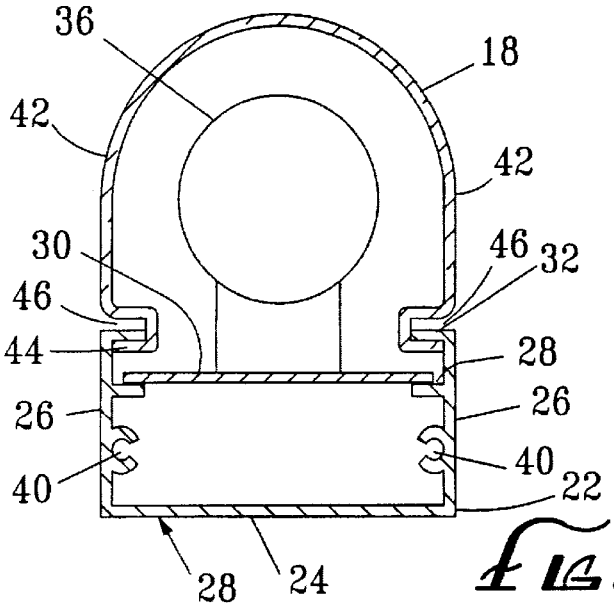
FIG. 3 is a transverse cross-sectional view of the lighting fixture of FIG. 1, taken on line 3—3 in FIG. 2.

Fastened to the bottom wall 24 of the base 16 are conventional supports 34 for supporting and electrically connecting an elongated, tubular, fluorescent light 36. The light supports 34 are mounted to the base 16 with fasteners such as screws 38. As best shown in FIG. 2, the reflective top 30 does not extend the entire length of the base 16, so as to provide a gap for the light support 34 to extend upwardly from the bottom wall 24 of the base so that the fluorescent light 36 can be mounted above the reflective top 30.

Each side wall 26 of the base 16 has, below the bottom lip 28, an inwardly projecting fastener receiver 40.

The cover 18 is preferably formed of a flexible, light-transmitting polymeric material such a Lexan brand polycarbonate resin. It can be formed of acrylic resin. The cover 18 is generally semi-spherical in cross section, being of the form of an elongated half cylinder, having opposed side walls 42 and bottom edges 44. It can be formed from 0.060 inch thick extruded acrylic and it can be provided with internal ribs.

There is a detent 46 on the outside of each bottom edge 44 of the cover 18 for receiving the top lip 32 of the base 16. Thus the base 16 engages the cover 18 to hold it in place. Due to the elastically flexible nature of the material used for the cover 18, merely by pressing on the opposite side walls 42 of the cover 18, using two hands, one at each end of the cover 18, the cover 18 can be removed from the base 16.

According to the present invention, the end caps 20 are mounted to the base 16 in a manner that does not interfere with easy removal of the cover 18. In particular, the end caps 20 are flat plates sized and shaped to conform to the end portion of the light fixture, i.e., the open end resulting from the shape of the cover 18 and the base 16. The end caps 20 cover this space but do not overlap the sides of either the cover or the base. The end caps 20 are held in place by fastening means that allows the caps 20 to be held in place without impinging upon or interfering with the easy removal of the cover 18 from the base 16.

In a preferred version of the invention, the fastener means include the receivers 40, and fasteners 48 extending through holes in the end caps, and received in the fastener receivers 40. The fasteners 48 can be screws, bolts, rivets, or any other type of fastener.

The supports 34 are selected to accommodate the particular light 30 used with the fixture. The light 36 can be conventional fluorescent lights, such as a T8 lamp. The light can also be a T-8 lamp, T12HT12VHO or T10 jacketed lamps, or cold cathode lamps for reduced wattage, reduced heat, 24 volt operation, and long life (40,000 plus hours).

The base 10 preferably is formed of extruded aluminum, which typically is 0.050 inch thick. Similarly, the reflective top 30 can be made from a 0.040 inch thick aluminum. The end caps or plates 20, can be formed from 0.032 inch aluminum. The typical base 16 has a width of about 2 inches and height of about 1 inch. The overall height of a typical lighting fixture from the bottom of the base to the top of the light is typically about 2.75 inches. The base 16 is sized to be retrofitted into existing light-receiving recesses. The base can be provided with apertures for receiving fasteners for attachment to the support surface, or can be held on the support surface by an adhesive or the like.

Although the present invention has been described in considerable detail with reference to certain preferred versions thereof, other versions are possible. For example, although the lighting fixture 10 shown in the drawing supports a single light, the present invention can be used with two lights, side-by-side, merely by modifying the dimensions and the electrical connections of the fixture 10.

Further, the base 16 need not be made of aluminum, but can be made of alternative materials, such as steel or structural plastic. Also, the lighting fixture 10 can be used with lights other than fluorescent lights. Therefore, the spirit and scope of the appended claims should not be limited to the description of the preferred versions contained herein.

What is claimed is:

1. A lighting fixture comprising:

a) a base having a bottom wall, opposed side walls, and at least one open end;

b) a support on the base for supporting and electrically connecting a light to the lighting fixture;

c) a light transmitting cover removably supported by the base for protecting the light supported by the base, wherein the cover can be removed from the base without any tools for easy access to the light supported by the base for replacement of the light;

d) an end cap closing off the open end of the base; and e) securing means for securing the end cap to the base so that the cover can be removed from the base without removing the end cap.

2. The lighting fixture of claim 1 wherein the cover is elastically flexible and includes a detent, and the base includes a lip engaging the detent for removably receiving the cover on the base.

3. The lighting fixture of claim 1 including a reflector supported by the base.

4. A lighting fixture for installation into an elongated recess in a refrigeration unit, the fixture comprising:

a) an elongated base having a bottom wall, opposed parallel side walls, and at least one open end, the base being U-shaped in vertical cross section for fitting into the elongated recess, the base having a lip;

b) a support on the base for supporting and electrically connecting a single fluorescent light to the lighting fixture with no ballast in the base;

c) a light transmitting, elastically flexible cover removably supported by the base for protecting the light supported by the base, the cover having a detent engaged by the base lip, the base removably receiving the cover, there being no obstruction between the light and the cover for light transmission; and d) a separate end cap for each open end of the base and secured to the base without overlapping the cover so the cover can be removed from the base without disassembly of the lighting fixture.

5. The lighting fixture of claim 4 wherein the securing means comprises fastener receivers extending inwardly from the side walls and fasteners extending through the end cap into the fastener receivers.

6. The lighting fixture of claim 5 wherein the fastener receivers are integral with the base.

7. The lighting fixture of claim 4 wherein the securing means are integral with the base.

8. The lighting fixture of claim 4 wherein the base has opposed open ends and two end caps, one for each end.

9. The lighting fixture of claim 4 with the light supported by the support.

10. The lighting fixture of claim 4 wherein the cover is formed of polycarbonate resin.

11. The lighting fixture of claim 4 wherein the base is formed of extruded aluminum.

12. The lighting fixture of claim 4 wherein the cover is an elastically flexible polycarbonate cover.

13. The lighting fixture of claim 4 including a reflector supported by the base.

14. A lighting fixture, for installation into a refrigeration unit, having a light support surface with an elongated light-receiving recess therein, the lighting fixture being mounted in the recess, the lighting fixture comprising:

a) an elongated, extruded aluminum base generally U-shaped in cross-section having a bottom wall, opposed parallel side walls, and opposed open ends, each side wall having an inwardly extending lip and an inwardly extending fastener receiver;

b) a single, elongated fluorescent light bulb;

c) a support on the base supporting and electrically connecting the fluorescent light to the fixture with no ballast in the fixture;

d) a light transmitting, elastically flexible, polycarbonate cover removably supported by the base for protecting the light supported by the base, the cover having a detent for engaging the base slit so the cover can be removed from the base without any tools for easy access to the light supported by the base for replacement of the light;

e) a separate end cap closing off each open end of the base without overlapping the side walls of the base or the cover so the cover can be removed from the base without removing the end caps;

f) a reflector supported by the base; and g) fasteners connecting the end cap to the fastener receiver.

* * * * *